US009877131B2

(12) United States Patent
Grosche et al.

(10) Patent No.: US 9,877,131 B2
(45) Date of Patent: Jan. 23, 2018

(54) APPARATUS AND METHOD FOR ENHANCING A SPATIAL PERCEPTION OF AN AUDIO SIGNAL

(71) Applicant: Huawei Technologies Co., Ltd., Shenzhen, Guangdong (CN)

(72) Inventors: Peter Grosche, Munich (DE); Yue Lang, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/177,994

(22) Filed: Jun. 9, 2016

(65) Prior Publication Data

US 2016/0286329 A1 Sep. 29, 2016

Related U.S. Application Data

(63) Continuation of application No. PCT/EP2013/075975, filed on Dec. 9, 2013.

(51) Int. Cl.

| | |
|---|---|
| ***H04S 1/00*** | (2006.01) |
| ***H04R 5/04*** | (2006.01) |
| ***H04R 5/02*** | (2006.01) |

(52) U.S. Cl.

CPC ..... *H04S 1/007* (2013.01); *H04R 5/02* (2013.01); *H04R 5/04* (2013.01); *H04S 1/002* (2013.01); *H04R 2203/12* (2013.01); *H04R 2499/11* (2013.01); *H04R 2499/15* (2013.01); *H04S 2420/01* (2013.01); *H04S 2420/07* (2013.01)

(58) Field of Classification Search

None

See application file for complete search history.

(56) References Cited

U.S. PATENT DOCUMENTS

| | | | | |
|---|---|---|---|---|
| 4,058,675 | A | 11/1977 | Kobayashi et al. | |
| 5,809,150 | A | 9/1998 | Eberbach | |
| 5,870,484 | A * | 2/1999 | Greenberger | H04R 5/02 381/17 |
| 2008/0031474 | A1* | 2/2008 | Berardi | G10K 11/341 381/99 |
| 2008/0273721 | A1* | 11/2008 | Walsh | H04S 5/00 381/300 |

(Continued)

FOREIGN PATENT DOCUMENTS

| | | | |
|---|---|---|---|
| EP | 2222092 | B1 | 1/2013 |
| WO | 2013/040738 | A1 | 3/2013 |

(Continued)

OTHER PUBLICATIONS

Frank Baumgarte et al., "Binaural Cue Coding—Part I: Psychoacoustic Fundamentals and Design Principles", IEEE Transactions on Speech and Audio Processing, vol. 11, No. 6, Nov. 2003, p. 509-519.

(Continued)

*Primary Examiner* — Curtis Kuntz
*Assistant Examiner* — Qin Zhu

(57) ABSTRACT

An apparatus and a method for enhancing a spatial perception of an audio signal are provided creating increased interaural-level differences. To obtain this effect, two dipoles are used: one for producing a left audio signal and one for producing a right audio signal.

16 Claims, 11 Drawing Sheets

(56) References Cited

U.S. PATENT DOCUMENTS

| | | | | |
|---|---|---|---|---|
| 2010/0303264 | A1* | 12/2010 | Fletcher | H04R 1/24 381/300 |
| 2011/0216926 | A1* | 9/2011 | Riggs | H04R 5/02 381/300 |
| 2011/0248935 | A1* | 10/2011 | Mellow | G06F 1/1605 345/173 |
| 2012/0099733 | A1* | 4/2012 | Wang | H04S 1/002 381/17 |
| 2013/0101146 | A1* | 4/2013 | Mosgaard | H04R 5/02 381/300 |
| 2013/0336504 | A1* | 12/2013 | Mosgaard | H04R 5/02 381/300 |

FOREIGN PATENT DOCUMENTS

| | | | | |
|---|---|---|---|---|
| WO | WO 2013040738 | A1 * | 3/2013 | H04S 1/002 |
| WO | 2014/121828 | A1 | 8/2014 | |

OTHER PUBLICATIONS

Fr. Heegaard, "The Reproduction of Sound in Auditory Perspective and a Compatible System of Stereophony", J. Audio Eng. Soc., vol. 40, No. 10, Oct. 1992, p. 802-808.

B. B. Bauer, "Stereophonic Earphones and Binaural Loudspeakers", Journal of the Audio Engineering Society, vol. 9, No. 2, Apr. 1961, p. 148-151.

"Multichannel stereophonic sound system with and without accompanying picture", BS Series Broadcasting service (sound), ITU Recommendation ITU-R BS.775-3, Aug. 2012, 25 pages.

Harry F. Olson, "Gradient Microphones", The Journal of the Acoustical Society of America, vol. 17,No. 3, Jan. 1946, p. 192-198.

Jens Blauert, "Spatial Hearing, Revised Edition, The Psychophysics of Human Sound Localization", The MIT Press, Oct. 1996, 1 page.

* cited by examiner

APPARATUS AND METHOD FOR ENHANCING A SPATIAL PERCEPTION OF AN AUDIO SIGNAL

CROSS-REFERENCE TO RELATED APPLICATIONS

This application is a continuation of International Application No. PCT/EP2013/075975, filed on Dec. 9, 2013, which is hereby incorporated by reference in its entirety.

TECHNICAL FIELD

The present application relates to the field of sound generation, and particularly to an apparatus and a method for enhancing a spatial perception of a two-channel audio signal.

BACKGROUND

There are many devices with two transducers on the market, such as laptops, tablet computer, mobile phones, and smartphones, as well as portable media players or smartphone docking stations and soundbars for TVs. Compared to a conventional stereo system with two discrete loudspeakers, the two transducers of such devices are located in a single cabinet or enclosure and are typically placed very close to each other. Due to the size of these devices, the transducers are usually spaced from each other by only few centimeters.

This results in a narrow sound reproduction, almost "mono-like". When playing a stereo recording on such devices, all sound sources are perceived as being centered.

Several different solutions have been proposed in order to increase the spatial effect of such systems with small loudspeaker span angles using different concepts.

EP 2 222 092 B1, for example, describes beamforming used in soundbars, with the goal to reflect acoustic beams of sound on walls surrounding the listener in order to achieve a spatial effect. The impression of sound arriving from the right side can be achieved by steering a beam to a position on the right wall where it is reflected and arrives at the listener. While this method can achieve convincing spatial effects, it requires a large number of transducers and relies on regular walls with good reflective properties all around the listener. Furthermore, a calibration of the system is needed to adapt to the room properties.

SUMMARY

It is the object of the invention to provide an improved technique for reproducing a two-channel audio signal, e.g. a stereo signal or a binaural signal.

This object is achieved by the features of the independent claims. Further implementation forms are apparent from the dependent claims, the description and the figures.

According to a first aspect, an apparatus for enhancing a spatial perception of a two-channel audio signal is provided, the two-channel audio signal comprising a first audio channel signal and a second audio channel signal, wherein the apparatus comprises a dipole steering unit, and wherein the dipole steering unit comprises: a first dipole steering module adapted to produce a first dipole signal based on the first audio channel signal, a second dipole steering module adapted to produce a second dipole signal based on the second audio channel signal; wherein the first dipole steering module and the second dipole steering module are adapted to produce the first dipole signal and the second dipole signal such that, when output via a transducer unit, a first zero sound propagation direction of the first dipole signal has a positive azimuth angle with regard to a steering reference direction, and a second zero sound propagation direction of the second dipole signal has a negative azimuth angle with regard to the steering reference direction, and wherein transducer unit comprises at least one pair of transducers. The apparatus can comprise the transducer unit, e.g., can comprise an integrated transducer unit, or can be connected or at least connectable to a separate transducer unit.

The invention is based on the finding that a spatial effect can be obtained by creating increased interaural-level differences. Interaural-level differences refer to differences in sound pressure level between the two ears of a listener. To obtain this effect, two dipoles are used: one for producing a left side signal and one for producing a right side signal.

The left side dipole is rotated by $\alpha_L>0°$, the r0ight side dipole is rotated by $\alpha_R<0°$. As a result, the right side dipole emits more energy to the right side; the left side dipole emits more energy to the left side. In comparison to rendering left and right side signals with omni-directional characteristic, the interaural-level differences are increased. The increased interaural-level differences between left and right ear create a stereo widening effect: the width of the stereo image is increased and sources may be localized outside of the line segment between the two loudspeakers and at a larger angle than the loudspeaker span angle.

The apparatus allows increased spatial effects for small loudspeaker span-angles, e.g., for mobile devices. The spatial effect is based on increased interaural-level differences, computation and implementation are simple, the apparatus does not require many transducers, it can even be used with just two transducers. Advantageously, the apparatus can be easily adapted to different setups, with various numbers of transducers and different spacing.

The apparatus is robust and not affected by ill-conditioned filter inversion as conventional crosstalk cancellation. No colorization occurs in the sweet spot, and only little colorization is present outside of the sweet spot. The stereo widening effect even occurs outside of the sweet spot and interaural level differences can be adjusted using the steering angle.

The invention can be employed for widening stereo playback using the crosstalk cancellation embodiment in combination with a head-related transfer function (HRTF) which is a response that characterizes how an ear receives a sound from a point in space. It is also possible to place sources all around the listener to achieve virtual surround sound.

In a first possible implementation form of the apparatus according to the first aspect, the first dipole signal and the second dipole signal are further produced such that, when output via the transducer unit, a first main sound propagation direction of the first dipole signal has a negative azimuth angle with regard to the steering reference direction, and a second main sound propagation direction of the second dipole signal has a positive azimuth angle with regard to the steering reference direction.

The usage of two differing main sound propagation directions for each of the dipole signals beneficially permits to increase the spatial effect for small loudspeaker span angles as, for instance, available in mobile devices.

In a second possible implementation form of the apparatus according to the first aspect as such or according to the first implementation form of the first aspect, the first audio channel signal is a left audio channel signal, the second audio channel signal is a right audio channel signal, and the first dipole signal and the second dipole signal are further produced such that, when the steering reference direction points towards a user facing the transducer unit, the first zero propagation direction points towards the right ear of the user, and the second propagation direction points towards the left ear of the user.

The apparatus allows providing dipole signals with enhanced spatial perception steering to a desired direction, e.g. to a direction, to which a listener is and in particular the ears of the listener are positioned and, thus, provides an improved technique for reproducing or generating a stereo signal. Interaural-level differences can be adjusted to the desired perceivable level using the steering angle.

In a third possible implementation form of the apparatus according to the first aspect as such or according to the any of the preceding implementation forms of the first aspect, the transducer unit comprises a first pair of transducers and a second pair of transducers, wherein the first pair of transducers is configured to emit the first dipole signal and the second pair of transducers is configured to emit the second dipole signal, wherein the first pair of transducers and the second pair of transducers are located in fixed position with respect to each other. The two pairs of transducers may, for example, be integrated in a housing of a device.

The apparatus comprising two pairs of transducers is more robust and not affected by ill-conditioned filter inversions as conventional crosstalk cancellation.

In a fourth possible implementation form of the apparatus according to the third implementation form of the first aspect, the first pair of transducers and the second pair of transducers are spaced by a distance of less than 5 cm, less than 10 cm, or less than 40 cm.

When the distance is within that range, the enhanced spatial effect can be steered in all possible directions in front of a mobile device or a docking station or a soundbar applying that method.

In a fifth possible implementation form of the apparatus according to the first aspect as such or according to any of the preceding implementation forms of the first aspect, the first dipole steering module and the second dipole steering module are adapted to produce the first dipole signal and the second dipole signal such that, when output via the transducer unit, perceivable interaural-level differences in a sound field are generated by the transducer unit.

A just noticeable change in interaural-level difference is between 0.5 and 1 dB. A spatial effect may be based on perceivable interaural-level differences of approximately 4 dB level differences or larger.

In comparison to rendering left and right side signals with omni-directional characteristic, the interaural-level differences are increased. The increased interaural-level differences between left and right ear create a stereo widening effect.

In a sixth possible implementation form of the apparatus according to the first aspect as such or according to any of the preceding implementation forms of the first aspect, the apparatus further comprises a filter bank unit adapted to filter the input audio signal with a filter characteristic generating a bandwidth limited input audio signal, which is provided as input signal for the dipole steering unit.

A filter bank unit is an array of band-pass filters that separates the input signal into multiple components.

In a seventh possible implementation form of the apparatus according to the first aspect as such or according to any of the preceding implementation forms of the first aspect, the transducing unit comprises only one pair of transducers, wherein the one pair of transducers is connected such to the dipole steering module that the one pair of transducers is adapted to emit the first dipole signal and the second dipole signal.

This allows a further reduction concerning the number of transducers needed for a sound generation with enhanced a spatial perception.

In an eighth possible implementation form of the apparatus according to the first aspect as such or according to any of the preceding implementation forms of the first aspect, each of the first dipole signal and the second dipole signal contains a first signal component and a second signal component which are different with respect to sign and phase.

The inverted signal component of the first dipole signal and the second dipole signal enables the creation of the non-omni-directional characteristic.

In a ninth possible implementation form of the apparatus according to the eighth implementation form of the first aspect, the dipole steering unit is configured to adapt the first audio channel signal and the second audio channel signal such that the difference in phase between the first signal component and a second signal component is obtained by delaying the first signal component or the second signal component.

The delaying advantageously allows by means of an implementation by integrated electronics to generate a difference in phase between the first signal component and a second signal component and enables the steering of the dipole towards different angles.

In a tenth possible implementation form according to the eighth implementation form of the first aspect or according to the ninth implementation form of the first aspect, the dipole steering unit is configured to adapt the first audio channel signal and the second audio channel signal such that the difference in sign between the first signal component and a second signal component is obtained by inverting the first signal component or the second signal component.

The inverting can be advantageously conducted by means of an implementation of integrated electronics.

In an eleventh implementation form according to any of the preceding implementation forms of the first aspect or according to first aspect, the dipole steering unit further comprises a filter bank unit and a first summation amplifier and a second summation amplifier; wherein the filter bank unit is configured to separate each of the first audio channel signal and the second audio channel signal, into at least a low frequency subband component, a mid frequency subband component and a high frequency subband component; wherein the first dipole steering module is configured to receive and process the mid frequency component of the first audio channel signal; wherein the second dipole steering module is configured to receive and process the mid frequency component of the second audio channel signal; wherein the first summation amplifier is adapted to receive and sum the steered mid frequency component of the first audio channel signal from the first dipole steering module and the low frequency component and the high frequency component of the first audio channel signal from the filter bank unit, and to output the summed signal as a first transducer driving signal; and wherein the second summation amplifier is adapted to receive and sum the steered mid frequency component of the second audio channel signal from the second dipole steering module and the low frequency component and the high frequency component of the first audio channel signal from the filter bank unit, and to output the summed signal as a first transducer driving signal.

According to a second aspect, the invention relates to a mobile device comprising an apparatus according to the first aspect as such or according to any of the preceding implementation forms of the first aspect, wherein the at least one pair of transducers of the transducer unit of the apparatus is provided by at least one pair of loudspeakers of the mobile device.

This provides an increased spatial effect even for small loudspeaker span angles as given in mobile devices.

According to a third aspect, the invention relates to a docking station comprising an apparatus according to the first aspect as such or according to any of the preceding implementation forms of the first aspect, wherein the at least one pair of transducers of the transducer unit of the apparatus is provided by at least one pair of loudspeakers of the docking station.

According to a fourth aspect, the invention relates to a soundbar comprising an apparatus according to the first aspect as such or according to any of the preceding implementation forms of the first aspect, wherein the at least one pair of transducers of the transducer unit of the apparatus is provided by at least one pair of loudspeakers of the soundbar.

According to a fifth aspect, the invention relates to a method for enhancing a spatial perception of a two-channel audio signal, the two-channel audio signal comprising a first audio channel signal and a second audio channel signal, said method comprising the steps of: producing a first dipole signal based on the first audio channel signal and producing a second dipole signal based on the second audio channel signal, wherein the first dipole signal and the second dipole signal are produced such that, when output via a transducer unit comprising at least a pair of transducers, a first zero sound propagation direction of the first dipole signal has a positive azimuth angle with regard to a steering reference direction, and a second zero sound propagation direction of the second dipole signal has a negative azimuth angle with regard to the steering reference direction.

The method can be applied for multichannel audio signals. Thus, the method can be applied for compressed stereo signals. The method can be used for decreasing computational complexity.

In a first possible implementation form of the method according to the fifth aspect, the method further comprises the step of adapting the left side signal and the right side signal by means of the dipole steering unit to generate increased interaural-level differences in a sound field generated by the transducer unit.

Implementing the method saves computational complexity.

The methods, systems and devices described herein may be implemented as software in a Digital Signal Processor (DSP) in a micro-controller or in any other side-processor or as hardware circuit within an application specific integrated circuit (ASIC).

The invention can be implemented in digital electronic circuitry, or in computer hardware, firmware, software, or in combinations thereof, e.g., in available hardware of conventional mobile devices or in new hardware dedicated for processing the methods described herein.

BRIEF DESCRIPTION OF THE DRAWINGS

Further embodiments of the invention will be described with respect to the following figures, in which.

DETAILED DESCRIPTION

Figure 1:
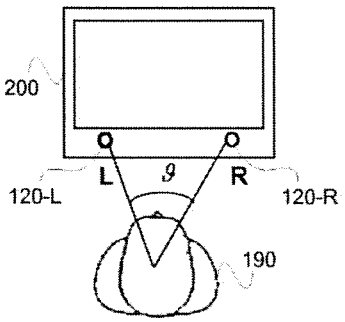
FIG. 1 shows a schematic diagram of a stereo mobile device according to an embodiment of the invention.

FIG. 1 shows a schematic diagram of a stereo mobile device according to an embodiment of the invention.

The stereo mobile device 200 comprises a left path transducer 120-L and a right path transducer 120-R. The transducers 120-L and 120-R can be comprised in or can be conventional omnidirectional loudspeakers, i.e., no special hardware for implementing dipole loudspeakers is required for embodiments of the invention comprising a dipole steering unit as described later in more detail.

As illustrated in FIG. 1, the two transducers 120-L and 102-R of the device 200 are located in a single cabinet or enclosure and are typically placed very close to each other. Due to the size of the device 200, they can be usually spaced by only few centimeters, e.g. between 2 and 30 cm for a mobile device 200 (e.g., when the mobile device 200 is a smartphone or a tablet). For typical listening distances, the loudspeaker span angle θ(see FIG. 1) between the left transducer 120-L and the right transducer 120-R with regard to a listener 190 is small, i.e., less than the 60 degrees which are recommended for stereo playback. Left and right are denoted by L and R in FIG. 1 and the other parts of the specification.

Figure 2:
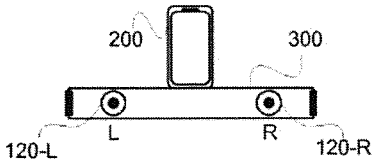
FIG. 2 shows a schematic diagram of a stereo docking station device according to an embodiment of the invention.

FIG. 2 shows a schematic diagram of a stereo docking station device 300 according to an embodiment of the invention with the mobile device 200 plugged in. As can be seen from FIG. 2, the stereo docking station device 300 provides a simplified way of "plugging-in" the electronic mobile device 200. Although in FIG. 2 the mobile device 200 shown in FIG. 1 is plugged into the stereo docking station 300, any other mobile device may be plugged into the stereo docking station 300. The stereo docking station device 300 shown in FIG. 2 comprises a left transducer 120-L and a right transducer 120-R.

Figure 3:
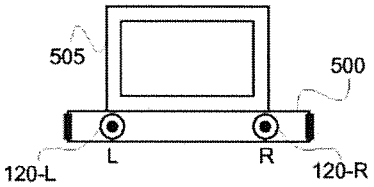
FIG. 3 shows a schematic diagram of a stereo soundbar device according to an embodiment of the invention.

FIG. 3 shows a schematic diagram of a stereo soundbar device 500 according to an embodiment of the invention.

As illustrated in FIG. 3, the soundbar device 500 can be connected to a television device 505. The soundbar comprises a left transducer 120-L and a right transducer 120-R.

In the following embodiments of dipole steering modules and dipole steering units as well as exemplary embodiments of dipole processing circuits implemented therein are described.

Figure 4A:
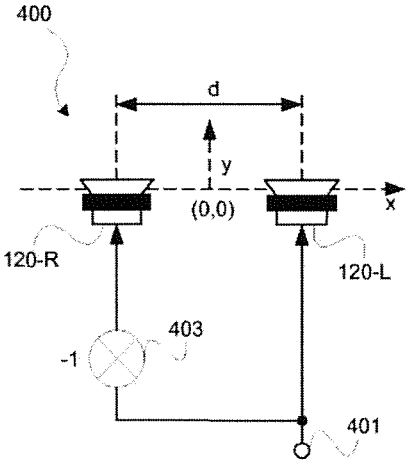
FIG. 4A shows a block diagram of a dipole processing circuit for explaining the invention.

FIG. 4A shows a block diagram of a dipole processing circuit 400 for explaining the invention. The corresponding directional dipole response of the circuit as shown in FIG. 4A is shown in FIG. 4B by means of a two-dimensional radiation plot.

In the circuit as shown in FIG. 4*a* a dipole characteristic is achieved using two spaced omnidirectional transducers 120-L, 120-R with the opposite phase centered at (X, Y)=(0, 0). The two transducers 120-L and 120-R are spaced from each other by a distance d. A signal from an input 401 is given to one transducer 120-L, and a corresponding inverted signal to the other transducer 120-R, as illustrated in FIG. 4A. The inverted signal is generated by multiplying the signal with a value of −1 via a multiplication amplifier 403 used as an inverting element.

Figure 4B:
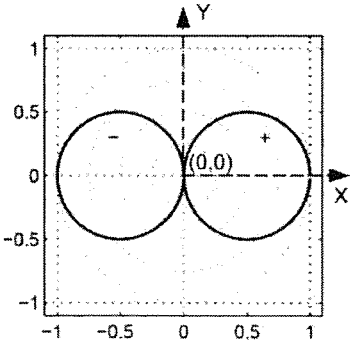
FIG. 4B shows the corresponding directional dipole response of the dipole processing circuit as shown in FIG. 4A by means of a two-dimensional radiation plot.

The corresponding directional dipole response of the circuit as shown in FIG. 4A is shown in FIG. 4B by means of a two-dimensional radiation plot. The response is maximal in X-direction and zero in Y-direction. The zero response in Y-direction is also called the null or zero sound propagation of the dipole. The plus (+) and minus (−) signs in the lobes indicate the relative polarization of the amplitude between the various lobes, which changes or alternates as the nulls are crossed. The maximum response in X-direction can also be called main or main sound propagation direction of the dipole.

Figure 5A:
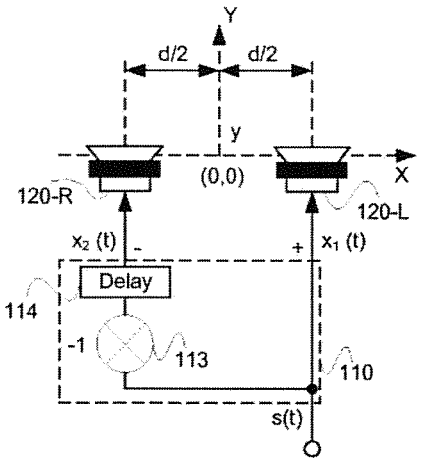
FIG. 5A shows a block diagram of a dipole steering module according to an embodiment of the invention.

FIG. 5A shows a block diagram of a dipole steering module 110 according to an embodiment of the invention, which is connected to two transducers or loudspeakers 120-L, 120-R.

The dipole steering module 110 comprises a multiplication amplifier module 113 and a delaying module 114.

The dipole characteristic is achieved using the two spaced transducers 120-L, 120-R which are spaced by a distance d. A signal s (t) from an input of the dipole steering module 110 is directly given as signal $x_1(t)$ at a plus-phased (+) output of the dipole steering module 110 to the first transducer or loudspeaker 120-L, and a corresponding inverted and delayed signal $x_2(t)$ at a minus-phased (−) output of the dipole steering module 110 is given to the second transducer or loudspeaker 120-R, as illustrated in FIG. 5A. The inverted and delayed signal $x_2(t)$ is generated by multiplying the signal s(t) with the value −1 using the multiplication amplifier module 113 and by delaying the resulting inverted signal using the delaying module 114. According to a further embodiment, the signal s(t) at the input is delayed first and afterwards the delayed signal is inverted to derive the inverted and delayed signal $x_2(t)$ at the minus-phased output of the dipole steering module 110.

By adding the further delay compared to the circuit in FIG. 4A, the direction of the null of the dipole can be controlled or steered. As described, the signal $x_1(t)$ is given to one loudspeaker 120-L, and the corresponding inverted and delayed signal $x_2$ (t) to the other loudspeaker 120-R. The two loudspeakers are driven with the signals $$x_1(t)=s(t)$$

$$x_2(t)=-s(t-\tau). \qquad \text{Equation (1)}$$

t denotes the time variable and τ denotes the delay introduced by delaying module 114. The sound field p(r,t) at radius r generated by such a pair of transducers in the far-field is $$p(r,t)=2j\sin\left(\frac{\omega}{2c}(c\tau+d\cos\varphi)\right)\frac{s\left(t-\frac{r}{c}-\frac{\tau}{2}\right)}{r}. \qquad \text{Equation (2)}$$

c denotes to the speed of sound, ω denotes to angular frequency. At low frequencies, equation (2) can be approximated by $$p(r,t)\approx j\omega\left(\tau+\frac{d}{c}\cos\varphi\right)\frac{s\left(t-\frac{r}{c}-\frac{\tau}{2}\right)}{r}\approx \frac{j\omega(c\tau+d)}{c}(u+(1-u)\cos\varphi)\frac{s\left(t-\frac{r}{c}-\frac{\tau}{2}\right)}{r}, \qquad \text{Equation (3)}$$

from which it can be seen that the ratio $$\frac{c\tau}{c\tau + d}$$

corresponds to a parameter, determining the directional response $$\text{directivity}(\varphi)=u+(1-u)\cos\varphi. \qquad \text{Equation (4)}$$

d represents the distance between the transducers. In a preferred embodiment, this distance is rather small and compatible with mobile device applications. It is then in the range of 2 to 40 cm. The parameter u, which steers the null towards $\alpha\epsilon[0, \ldots, \pi/2]$ is $$u = \frac{\cos\left(\frac{\pi}{2}+\alpha\right)}{\cos\left(\frac{\pi}{2}+\alpha\right)-1}. \qquad \text{Equation (5)}$$

For negative $\alpha\epsilon[0, \ldots, -\pi/2]$, the delay and inversion are applied to the other transducer and u in equation (5) is computed for $|\alpha|$. The delay $\tau$, corresponding to this u is $$\tau = \frac{ud}{c(1-u)}. \qquad \text{Equation (6)}$$

Figure 5B:
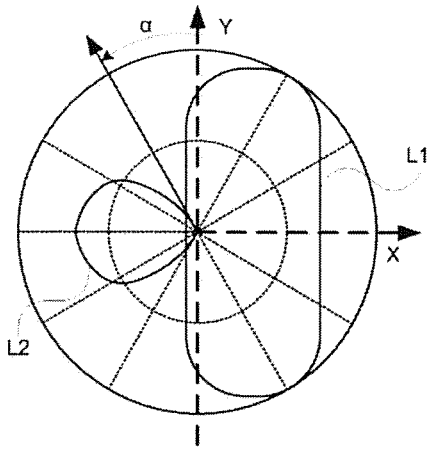
FIG. 5B shows the corresponding directional dipole response of the dipole steering module as shown in FIG. 5A by means of a two-dimensional radiation plot.

FIG. 5B shows the corresponding directional dipole response of the circuit as shown in FIG. 5A by means of a 2 dimensional polar radiation plot. The null of the dipole is steered by the angle $\alpha$. From the equations above it can be seen that the angle $\alpha$ and therefore the null of the dipole can be steered by varying the delay $\tau$. The complete transducer system (dipole steering module 110 with the two transducers or loudspeakers 120-L, 120-R) shows a directional response with two asymmetric lobes L1, L2.

Figure 6:
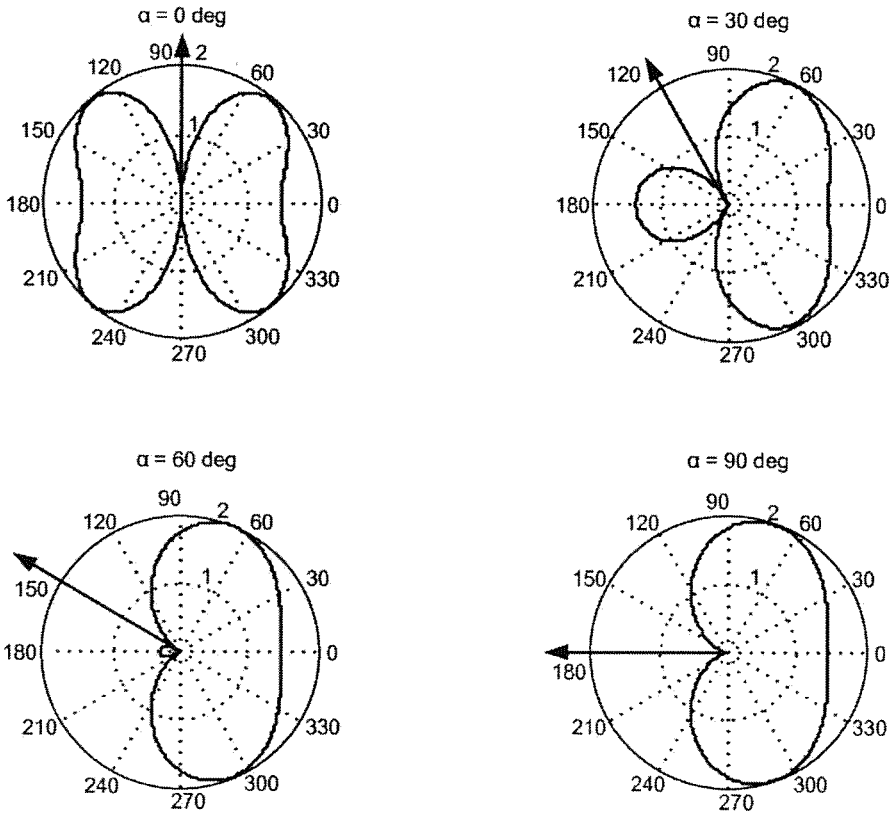
FIG. 6 shows resulting directional responses for different null steering angles $\alpha$ for the dipole steering module shown in FIG. 5A by means of two-dimensional radiation plots.

FIG. 6 shows resulting directional responses for 4 different null steering angles $\alpha$ for the dipole steering module 110 shown in FIG. 5A connected to the two transducers 120-L, 120-R (i.e. for the dipole transducer system shown in FIG. 5A) by means of polar radiation plots. As pointed out, these different null steering angles can be achieved by varying the delay $\tau$ in the dipole steering module 110, wherein the specific delay $\tau$ to obtain a specific null steering angle $\alpha$ depends on the distance d of the two transducers. This provides a simple way of controlling the speaker directivity and enables creating spatial effects.

In the first polar radiation plot (top left of FIG. 6) the steering angle $\alpha$ is 0°. The dipole loudspeaker characteristic shows a symmetric response with a symmetric first-order polar pattern.

In the second polar radiation plot (top right of FIG. 6) the steering angle $\alpha$ is 30°. The dipole loudspeaker characteristic shows an asymmetric response with a first-order polar pattern.

In the third polar radiation plot (bottom left of FIG. 6) the steering angle $\alpha$ is 60°. The dipole loudspeaker characteristic shows an asymmetric response with a first-order polar pattern with a prominent main lobe.

In the fourth polar radiation plot (bottom right of FIG. 6) the steering angle $\alpha$ is 90°. The dipole loudspeaker characteristic shows an asymmetric response with a first-order polar pattern with a prominent main lobe.

In the following, technical principles of embodiments of the invention will be explained based on FIGS. 7 to 9.

Figure 7:
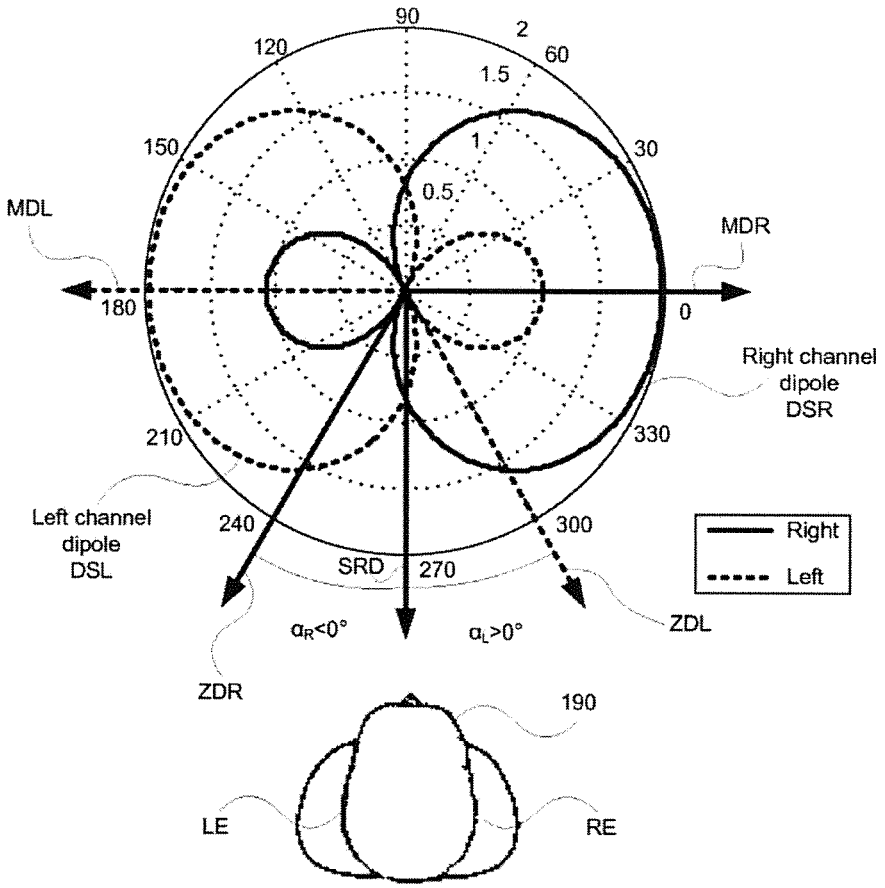
FIG. 7 shows exemplary polar radiation plots of two dipoles and corresponding zero sound propagation directions to obtain a stereo reproduction with increased interaural-level differences according to an embodiment of the invention.

FIG. 7 shows polar radiation plots of a transducer system with a user facing the transducer system according to an embodiment of the invention. In particular, FIG. 7 shows the directional response of two dipoles used to obtain a stereo reproduction with increased interaural-level differences. As mentioned before, embodiments of the invention provide two-channel audio signals, e.g., stereo signals, with enhanced spatial perception by creating increased interaural-level differences (ILD). Interaural-level differences (ILD) refer to differences in the sound pressure levels between the two ears of a listener, i.e. the left ear LE and the right ear RE. To obtain the effect of increased interaural-level differences, two dipoles, e.g. dipole steering modules and corresponding transducers, are used: one for producing a left side dipole signal and one for producing a right side dipole signal. The zero sound direction ZDL of the left side dipole signal SDL is rotated by $\alpha_L>0°$ and the zero sound direction ZDR of the right side dipole signal DSR is rotated by $\alpha_R<0°$ with regard to a common steering reference direction SRD. At the same time, the main sound direction MDL of the left side dipole signal DSL points to the left side (see the larger lobe of the left side dipole signal DSL shown in broken lines in FIG. 7) and the main sound direction MDR of the right side dipole signal DSR points to the right side (see the larger lobe of the right side dipole signal DSR shown as continuous line in FIG. 7). As a result, the left side dipole signal DSL emits more energy to the left side and the right side dipole signal DSR emits more energy to the right side, which generates perceivable interaural-level differences. Thus, the interaural-level differences are increased compared to conventional rendering of left and right side signals with omni-directional characteristic, e.g., by applying the left side stereo signal directly to the left side transducer and the right side stereo signal directly to the right side transducer. The increased interaural-level differences between left and right ear create a stereo widening effect: the perceived width of the stereo image is increased and sources may be localized at a larger angle than the loudspeaker span angle $\theta$.

Therefore, as will be described in more detail starting from FIG. 11, according to an embodiment of the invention, a first dipole steering module, such as the dipole steering module 110-L, is adapted to produce a first dipole signal DSL based on a first audio channel signal, e.g., a left channel signal, and a second dipole steering module, such as the dipole steering module 110-R, is adapted to produce a second dipole signal DSR based on a second audio channel signal (e.g., a right channel signal).

Accordingly, the first dipole signal and the second dipole signal are produced by the corresponding dipole steering modules such that, when output via the transducer unit, a first zero sound propagation direction ZDL of the first dipole signal has a positive azimuth angle with regard to a steering reference direction SRD, and a second zero sound propagation direction ZDR of the second dipole signal has a negative azimuth angle with regard to the steering reference direction SRD. The steering reference direction SRD is, as shown in FIG. 7, the direction pointing from the transducer unit 120 towards the position a listener 190 would typically be located at when listening to the audio signal. As mentioned above, the transducer unit can be integrated in the same device or apparatus as the dipole steering unit or can be implemented in a separate device.

According to further embodiments of the invention, the dipole steering can be also configured to obtain a crosstalk cancellation effect. In such embodiments the zero sound propagation direction of the dipole signals is steered to face the contra-lateral ear, as shown in FIG. 9.

Figure 9:
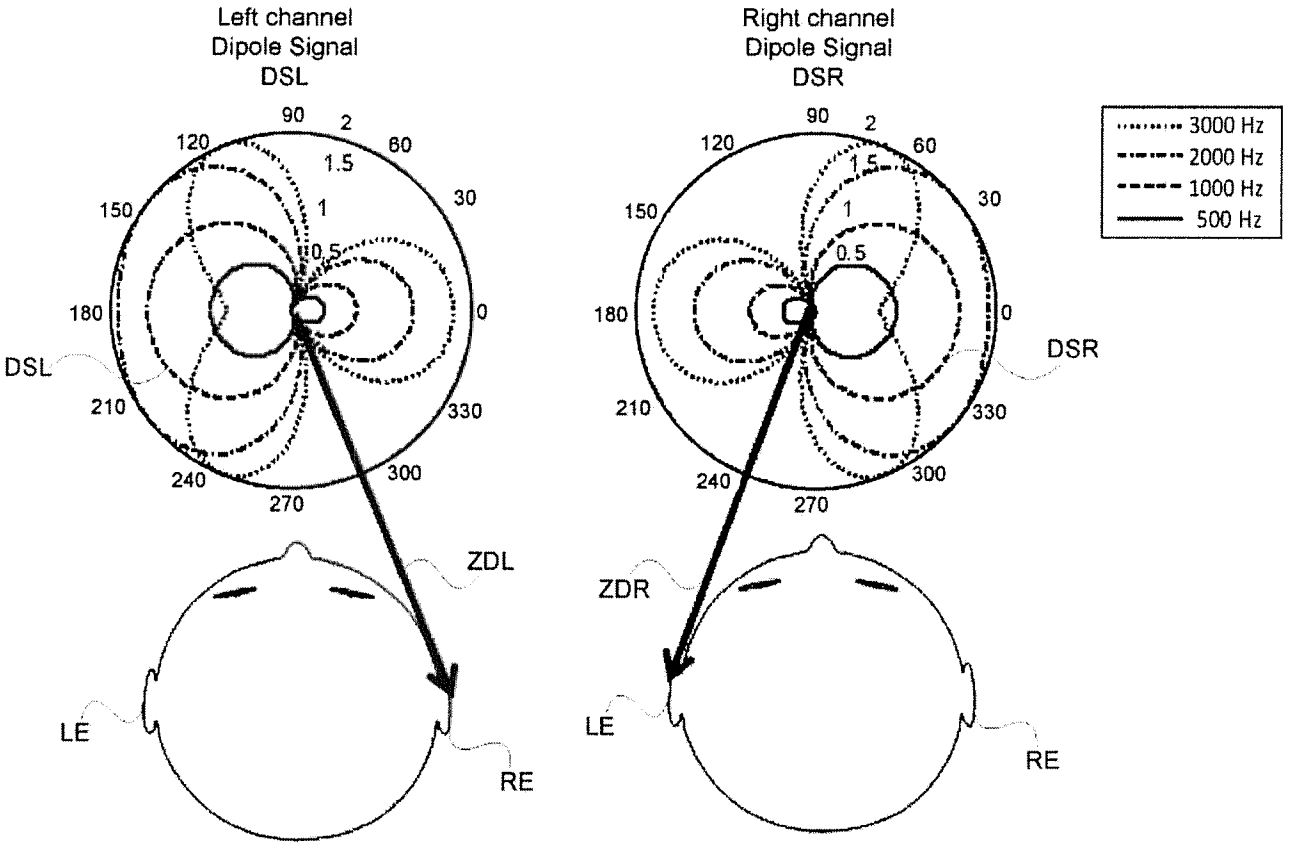
FIG. 9 shows two exemplary polar radiation plots and corresponding zero sound propagation directions steered to achieve a crosstalk cancellation effect.

FIG. 9 shows two polar radiation plots of an embodiment of the invention with crosstalk cancellation. FIG. 9 shows on the left side the polar radiation plot of the left side dipole signal DSL for different frequencies and on the right side the polar radiation plot of the corresponding right side dipole signal DSR for the same different frequencies. As can be seen from FIG. 9, the dipole steering is configured such that the direction of the dipole signals is steered to face the contra-lateral ear, i.e., the left side dipole signal DSL is steered such that the zero sound propagation direction ZDL of the left side dipole signal DSL points towards the right ear RE of the listener 190, and the right side dipole signal DSR is steered such that the zero sound propagation direction ZDR of the right side dipole signal DSR points towards the left ear LE of the listener 190.

In other words, such embodiments maximize the inter-aural level differences: the level is maximized at the ipsi-lateral ear and minimized at the contra-lateral ear. This concept gives a similar crosstalk cancellation effect as filter inversion techniques but uses simpler and more robust dipole processing techniques.

Figure 8:
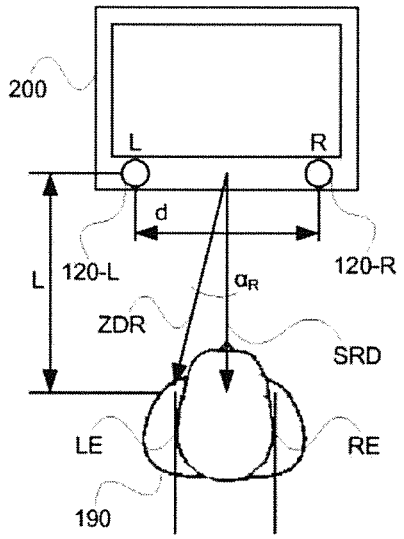
FIG. 8 shows a schematic illustration of optimal steering angles to achieve a crosstalk cancellation effect.

FIG. 8 shows a schematic diagram of a device 200 according to an embodiment of the invention with an integrated left side transducer 120-L and right side transducer 120-R with optimal steering angles to achieve a crosstalk cancellation effect at a user or listener 190 facing the device 200.

The optimal steering or rotation angles $\alpha_R$, $\alpha_L$ for the crosstalk cancellation embodiment depend on the listening distance L, i.e., the distance between the listener 190 and the device 200 respectively the transducer unit comprising the transducers, and the ear distance E, i.e., the distance E between the left ear LE and the right ear RE of the listener, see FIG. 8. Then, the angles can be computed according to:

$$\alpha_R = \tan^{-1}\left(\frac{E}{2L}\right),\ \alpha_L = -\alpha_R,$$

and the delay is obtained using equations (5) and (6). Hence, it can be seen that a first or left zero sound propagation direction ZDL of the first or left dipole signal has a positive azimuth angle (e.g. $\alpha_L$) with regard to a steering reference direction SRD, and a second or right zero sound propagation direction ZDR of the second or right dipole signal has a negative azimuth angle (e.g. $\alpha_R$) with regard to the steering reference direction.

Typical values (magnitudes) for a (e.g. $\alpha_R$ and/or $\alpha_L$) for different scenarios are approximately:

9° to 15° for smartphones

7° to 12° for tablets

2° to 9° for docking stations

FIG. 9 shows two polar radiation plots of a transducer system each with a user facing the transducer system according to an embodiment of the invention.

Figure 10A:
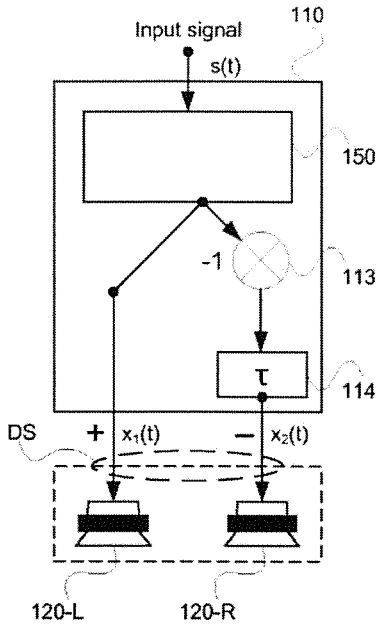
FIG. 10A shows a dipole steering module according to an embodiment of the invention.

FIG. 10A shows a block diagram of a dipole steering module 110 connected to a transducer unit 120 according to an embodiment of the invention.

The transducer unit 120 comprises the first transducer 120-L and the second transducer 120-R. The dipole steering module 110 comprises the multiplication amplifier module 113, which may also be designated as separation and inverting module 113, and the delaying module 114.

The implementation form of the dipole steering module 110 shown in FIG. 10A differs from the one shown in FIG. 5A in that it additionally comprises an equalization filter module 150.

The equalization filter module 150 may be designed or configured to compensate for the low-frequency gain loss of the dipole, when output via the transducers.

In embodiments of the dipole steering module 110 as shown in FIG. 10A, the input audio signal s(t) is provided to the input of the dipole steering module 110. The input signal s(t) is filtered by the equalization filter 150, e.g., a low-pass shelving filter 150 to make up for the low-frequency gain loss of the differential sound reproduction, to provide a filtered version of the input signal. The filtered version of the input signal is provided to the plus-phased output (see "+" in FIG. 10A) of the dipole steering module 110 to provide a first or left component $x_1(t)$ of the dipole signal DS, and to the inverting module 113 and the delaying module 114 to provide a second or right component $x_2(t)$ of the dipole signal DS at the minus-phased output (see "−" in FIG. 10A) of the dipole steering module 110. In other words, the separation and inverting element 113 is designed to obtain a pair of signals with opposite sign to create a dipole signal and the delaying element 114 in the inverted signal part enables the steering of the dipole signal towards different angles dependent on the delay τ. The first component $x_1(t)$ of the dipole signal DS is provided to the first transducer 120-L, and the second component $x_2(t)$ of the dipole signal DS is provided to the second transducer 120-R.

Figure 10B:
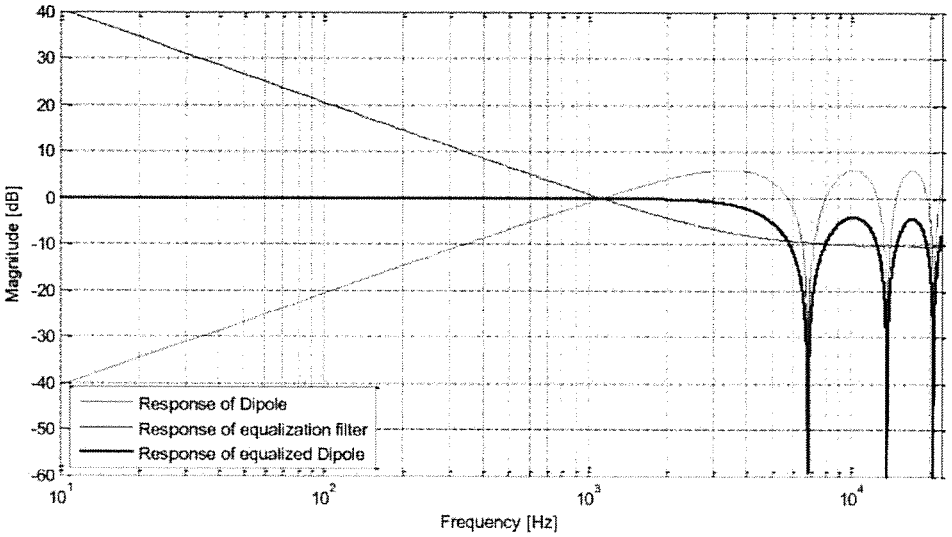
FIG. 10B shows a comparison between a frequency response of a dipole, a response of a corresponding equalization filter and the frequency response of the equalized dipole.

Exemplary filter magnitude responses are shown in FIG. 10B for a speaker or transducer pair with a distance d=20 cm and a rotation angle α=8° pointing to the contra-lateral ear. The directional response of the dipole signal shown in FIG. 10B corresponds to the direction of the ipsi-lateral ear. The response of the equalization filter compensates the dipole response and creates a flat response at the ipsi-lateral ear.

Alternative embodiments of the dipole steering module 110 as described based on FIG. 10A may comprise the delaying element 114 in the plus-phased signal path instead of the minus-phased signal path for steering the dipole signal. The same applies correspondingly for alternative embodiments of the dipole steering module described based on FIG. 5A.

In the embodiments described in the following, exemplarily the implementation form of the dipole steering module 110 shown in FIG. 5A or FIG. 10 can be used for the different dipole steering modules thereof.

Figure 11:
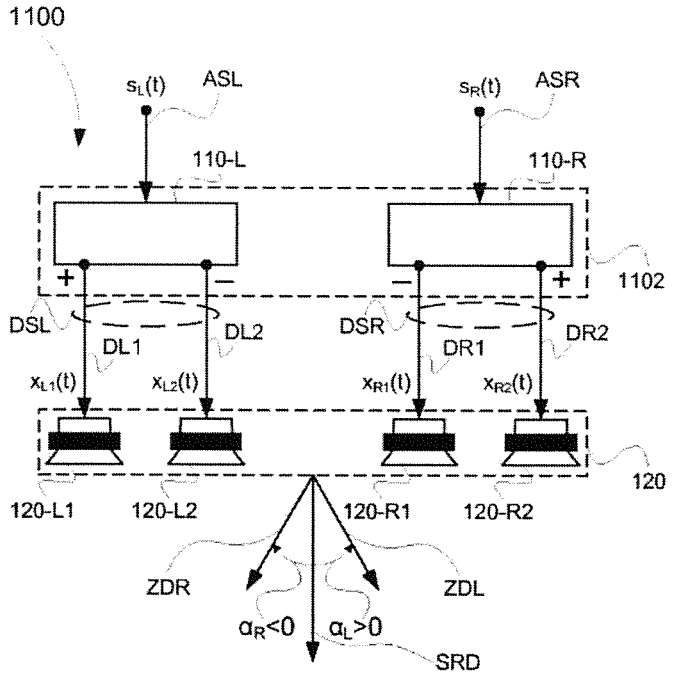
FIG. 11 shows an apparatus for enhancing a spatial perception of an audio signal according to an embodiment of the invention.

FIG. 11 shows an apparatus or transducer system 1100 for enhancing a spatial perception of an audio signal according to an embodiment of the invention, wherein the apparatus 1100 comprises a dipole steering unit 1102 and a transducer unit 120.

The dipole steering unit 1102 comprises two dipole steering modules, each dedicated to one dipole signal, i.e., a first or left dipole steering module 110-L adapted to steer the first or left dipole signal DSL and a second dipole steering module 110-R adapted to steer the second or right dipole signal DSR. The dipole steering unit can also be referred to as stereo reproduction unit. The transducer unit 120 comprises four transducers 120-L1, 120-L2, 120-R1 and 120-R2, which are used to form two pairs of dedicated transducers, one pair for each dipole signal, i.e. the transducers 120-L1, 120-L2 form the first or left transducer pair for the first or left dipole signal DSL and the transducers 120-R1, 120-R2 form the second or right transducer pair for the second or right dipole signal DSR.

To summarize, the embodiment shown in FIG. 11 provides an apparatus 1100 for enhancing a spatial perception of a two-channel audio signal s(t). The two-channel audio signal s(t) (e.g., a stereo signal s(t)) comprises a first audio channel signal ASL (e.g., a left channel signal $s_L(t)$) and a second audio channel signal ASR (e.g. a right channel signal $s_R(t)$).

The first (e.g., left channel) dipole steering module 110-L is adapted to produce a first dipole signal DSL (e.g., left dipole signal DSL) based on the first audio channel signal ASL.

The second (e.g., right channel) dipole steering module 110-R is adapted to produce a second dipole signal DSR (e.g., a right dipole signal DSR) based on the second audio channel signal ASR.

The first dipole signal DSL (e.g. $x_{L1}(t)$ and $x_{L2}(t)$) and the second dipole signal DSR (e.g. $x_{R1}$ (t) and $x_{R2}(t)$) are produced by the dipole steering modules 110-L, 110-R such that, when output via the transducer unit 120, a first zero sound propagation direction ZDL of the first dipole signal DSL has a positive azimuth angle with regard to a steering reference direction SRD, and a second zero sound propagation direction ZDR of the second dipole signal DSR has a negative azimuth angle with regard to the steering reference direction.

In embodiments of the apparatus 1100, the first and second dipole steering module may be implemented, for example, as described based on FIG. 5A or 10A.

In the following an embodiment of the apparatus 1100 will be described, wherein the first and second dipole steering modules 120-L and 120-R are implemented as described based on FIG. 10A.

Accordingly, the first dipole steering module 110-L comprises an equalization filter module 150, an inverting module 113 and a delaying module 114. The first dipole steering module 110-L is adapted to output at the positive phase output (see "+" of 110-L in FIG. 11) the filtered version of the first input signal ASL as driving signal DL1 (e.g., $x_{L1}(t)$) for the left transducer 120-L1 of the left transducer pair 120-L1 and 120-L2. The first dipole steering module 110-L is further adapted to output at the negative phase output (see "−" of 110-L in FIG. 11) the inverted, delayed and filtered version of the first input signal ASL as driving signal DL2 (e.g., $x_{L2}(t)$) for the right transducer 120-L2 of the left transducer pair 120-L1 and 120-L2.

The second dipole steering module 110-R also comprises an equalization filter module 150, an inverting module 113 and a delaying module 114. The second dipole steering module 110-R is adapted to output at the positive phase output (see "+" of 110-R in FIG. 11) the filtered version of the second input signal ASR as driving signal DR2 (e.g., $x_{R2}(t)$) for the right transducer 120-R2 of the right transducer pair 120-R1 and 120-R2. The second dipole steering module 110-R is further adapted to output at the negative phase output (see "−" of 110-R in FIG. 11) the inverted, delayed and filtered version of the second input signal ASR as driving signal DR1 (e.g., $x_{R1}(t)$) for the left transducer 120-R1 of the right transducer pair 120-R1 and 120-R2. Thus, the first dipole steering module 110-L is adapted to provide a first steered dipole signal DSL comprising a first dipole signal component DL1 or $x_{L1}(t)$, and a second dipole signal component DL2 or $x_{L2}(t)$, and the second dipole steering module 110-R is adapted to provide a second steered dipole signal DSR comprising a first dipole signal component DR1 or $x_{R1}(t)$, and a second dipole signal component DR2 or $x_{LR2}(t)$.

Figure 12:
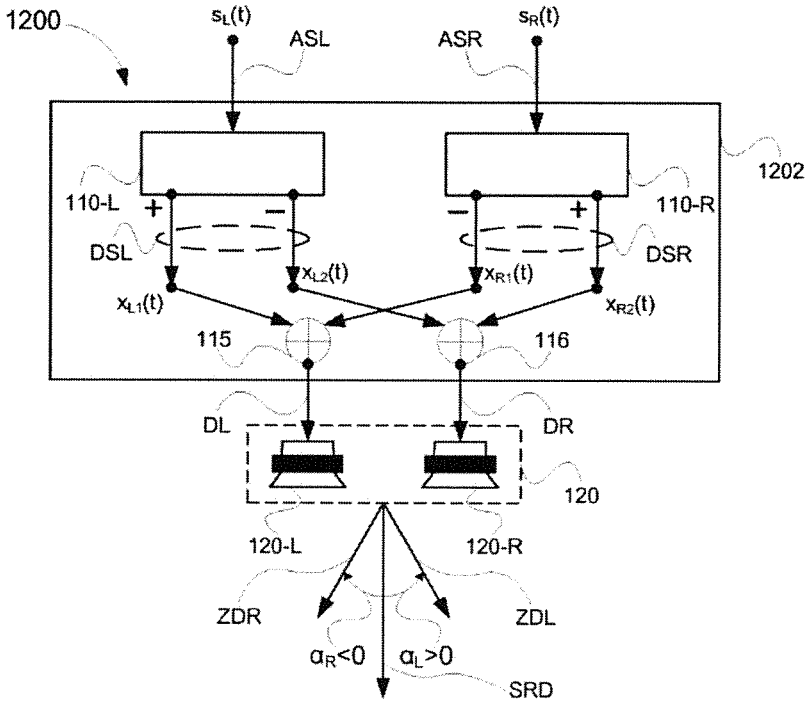
FIG. 12 shows an apparatus for enhancing a spatial perception of an audio signal according to another embodiment of the invention.

FIG. 12 shows an apparatus 1200 for enhancing a spatial perception of an audio signal according to a further embodiment of the invention.

According to a further embodiment, it is possible to combine two dipole steering modules 110-L, 110-R to implement a dipole steering unit 1202 which only requires one pair of transducers 120-L and 120-R. In such embodiments the two transducers 120-L and 120-R of the transducer unit 120 are shared between the two dipole steering modules 110-L and 110-R as shown in FIG. 12.

To achieve this sharing of the two transducers, the apparatus 1200 comprises a dipole steering unit 1202, which differs from the dipole steering unit 1102 shown in FIG. 11, in that it additionally comprises a first summation amplifier 115 and a second summation amplifier 116 to combine output signals of the two dipole steering modules. As explained with regard to FIG. 11, embodiments of the apparatus 1200 may comprise dipole steering units as described based on FIG. 5A (without filter 150) or FIG. 10A (with filter 150) or other dipole steering units.

In the following an embodiment of the apparatus 1200 will be described, wherein the first and second dipole steering modules 110-L and 110-R are implemented as described based on FIG. 10A.

As shown in FIG. 12 a plus-phased output of the first dipole steering module 110-L, at which a filtered version $x_{L1}(t)$ of the first audio channel signal $s_L(t)$ is provided, is connected to a first input of the first summation amplifier 115. A minus-phased output of the second dipole steering module 110-R, at which a filtered, delayed and inversed version $x_{R1}(t)$ of the second audio channel signal $s_R(t)$ is provided, is connected to a second input of the first summation amplifier 115. An output of the first summation amplifier 115, at which the combined or sum signal of the two aforementioned signals is provided as driving signal DL for the first transducer 120-L, is connected to the first transducer 120-L of the transducer unit 120 (comprising only two transducers 120-L and 120-R).

Furthermore a minus-phased output of the first dipole steering module 110-L, at which a filtered, delayed and inversed version $x_{L2}(t)$ of the first audio channel signal $s_L(t)$ is provided, is connected to a first input of the second summation amplifier 116. A plus-phased output of the second dipole steering module 110-2, at which a filtered version $x_{R2}(t)$ of the second audio channel signal $s_R(t)$ is provided, is connected to a second input of the second summation amplifier 116. An output of the second summation amplifier 116, at which the combined or sum signal of the two aforementioned signals is provided as driving signal DR for the second transducer 120-R, is connected to a second transducer 120-1 of the transducer unit 120. Hence, the resulting circuit is a cross-connection circuit.

The number of required transducers 120-1 is therefore minimized, in the given circuit from four to two transducers when compared to the circuit of FIG. 11. Embodiments of the invention with combined transducer driving signals, as exemplarily described based on FIG. 12, allow to reduce the number of required transducers and allow to reduce the required space for integrating the transducers, i.e., allow to further minimize the dimensions of the apparatus or device.

Figure 13A:
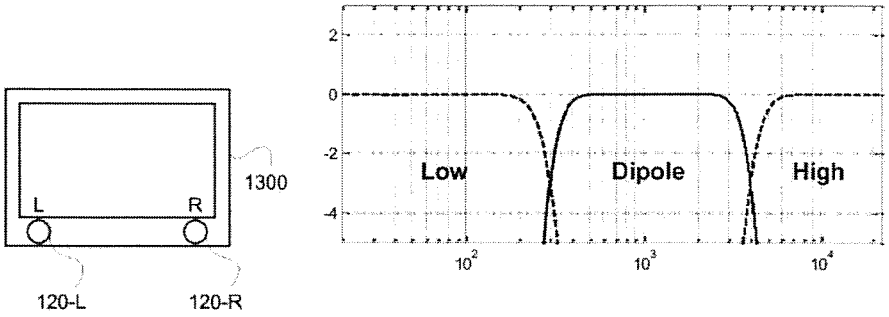
FIG. 13A shows on the left an apparatus for enhancing a spatial perception of an audio signal with two transducers according to an embodiment of the invention and on the right a corresponding frequency response of a filter bank implemented in this apparatus.

FIG. 13A shows a device 1300 according to an embodiment of the present invention. The device 1300 comprises an apparatus 1302 (see FIG. 13B) for enhancing a spatial perception of an audio signal according to an embodiment of the invention with two transducers 120-L and 120-R. Furthermore a corresponding frequency response of a filter bank 1304 used in the apparatus 1302 is shown. A possible implementation form of the apparatus 1302 comprising the filter bank 1304 is shown in FIG. 13B.

Two loudspeakers of the device 1300 are used as the two transducers 120-L and 120-R or comprise the two transducers 120-L and 120-R.

The directional response of the dipole depends on the loudspeaker distance d between the two transducers 120-L and 120-R and the frequency f of the audio signal output by the transducers. As a result, the dipole steering is effective in a limited frequency range. Towards high frequencies, the characteristic shape of the response diminishes. Towards low frequencies, the dipole response receives a 6 dB roll-off per octave which would require a large equalization gain, in particular in mobile devices with a small loudspeaker distance d.

Figure 13B:
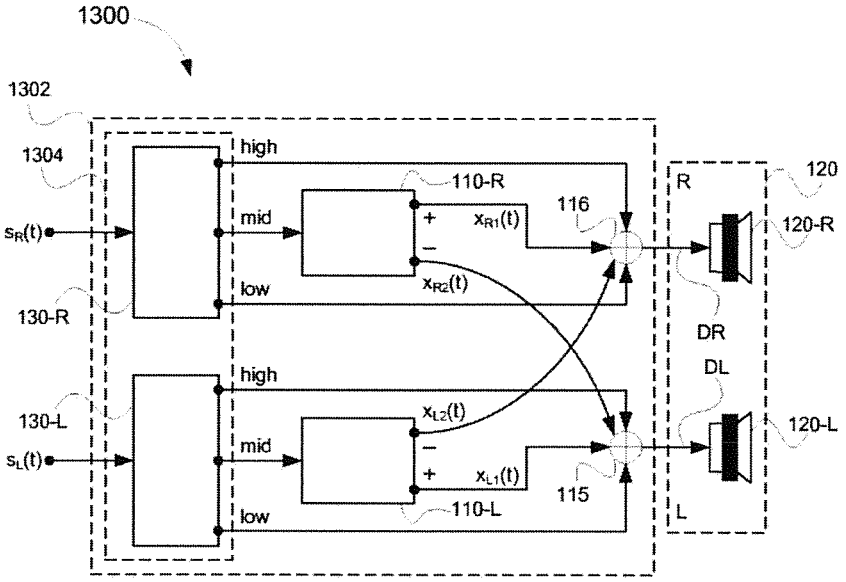
FIG. 13B shows a possible implementation form of the apparatus of FIG. 13A according to an embodiment of the invention.

Therefore, the apparatus 1300 comprises a dipole steering unit 1302 which comprises additionally to the components of the dipole steering unit 1202 a filter bank unit 1304 (see FIG. 13B). The filter bank unit 1304 comprises a first or left filter bank element 130-L and a second or right filter bank element 130-R. The filter bank elements 130-L, 130-R are used to band-limit the frequency range of the signal applied to the dipole processing. An exemplary frequency response of the first and second filter bank element is shown on the right hand side of FIG. 13A. The first filter bank element 130-L is configured to receive the first audio channel signal $s_L(t)$. The second filter bank element 130-R is configured to receive the second audio channel signal $s_R(t)$. The first and second audio channel signal $s_L(t)$, $s_R(t)$ are separated by the first and second filter bank element 130-L, 130-R into the following frequency subbands or components: mid frequencies (referenced as "mid" in FIG. 13B), comprising audio frequencies ranging approximately from 300 Hz to 4000 Hz, low frequencies (referenced as "low" in FIG. 13B), comprising audio frequencies approximately below 300 Hz, and high frequencies (referenced as "high" in FIG. 13B), comprising audio frequencies approximately above 4000 Hz. According to the embodiment depicted in FIG. 13B, only the mid frequencies of the first and second audio channel signal are processed by the respective dipole steering module 110-L, 110-R. The low and high frequencies of the first and audio second channel signal are directly played over the respective transducers 120-L and 120-R, i.e., bypass the dipole steering modules 110-L, 110-R.

FIG. 13B shows a cross connection scheme similar to that in FIG. 12. In the dipole steering unit 1302, a first summation amplifier 115 is adapted to receive and sum the high and low frequencies of the first audio channel signal $s_L(t)$, the filtered version $x_{L1}(t)$ of the mid frequencies of the first audio channel signal (t) and the filtered, delayed and inversed version $x_{R2}(t)$ of the mid frequencies of the second audio channel signal $s_R(t)$ and to output the sum as transducer driving signal DL to the first transducer 120-L. Furthermore the second summation amplifier 116 is adapted to receive the high and low frequencies of the second audio channel signal $s_R(t)$, the filtered version $x_{R1}(t)$ of the mid frequencies of the second audio channel signal $s_R(t)$ and the filtered, delayed and inversed version $x_{L2}(t)$ of the mid frequencies of the first audio channel signal $s_L(t)$ and to output the sum as transducer driving signal DR to the second transducer 120-R.

The transition frequencies depend on the distance d and angle $\alpha$ as well as the acceptable equalization gain. For the example shown in FIG. 10B (d=20 cm, $\alpha$=8°), the frequency range of the dipole can be configured to range from 600 Hz to 4000 Hz (i.e., the filter bank elements 130-L and 130-R are adapted to output to the dipole steering modules 110-L and 110-R a mid frequency subband signal comprising the frequency components of the first and second audio channel signals ranging from 600 Hz to 4000 Hz), when accepting a maximum gain of 6 dB. When accepting 10 dB equalization gain, the lower transition frequency could be reduced to 300 Hz (i.e., the filter bank elements 130-L and 130-R are adapted to output to the dipole steering modules 110-L and 110-R a mid frequency subband signal comprising the frequency components of the first and second audio channel signals ranging from 300 Hz to 4000 Hz). This is a preferred embodiment when using two transducers.

Figure 14A:
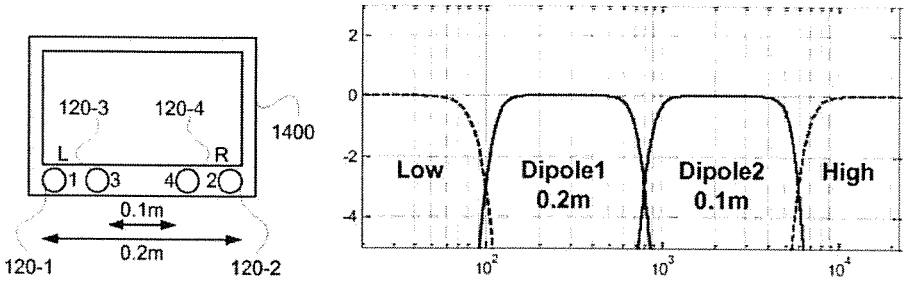
FIG. 14A shows an apparatus for enhancing a spatial perception of an audio signal with four transducers according to a further embodiment of the invention together with a corresponding frequency response of a filter bank implemented in this apparatus.

FIG. 14A shows a device 1400 according to an embodiment of the present invention. The device 1400 comprises an apparatus 1402 (see FIG. 14B) for enhancing a spatial perception of an audio signal according to an embodiment of the invention with four transducers 120-1, 120-2, 120-3 and 120-4 (or 1 to 4). In other words, the transducer unit 120 comprises four transducers 120-1, 120-2, 120-3 and 120-4. The apparatus 1402 further comprises a filter bank unit, which comprises two dedicated filter bank elements 130-L and 130-R. The first filter bank element 130-L is adapted to band-limit the frequency range of the signal applied to the dipole processing of the first audio channel signal $s_L(t)$. The second filter bank element 130-R is adapted to band-limit the frequency range of the signal applied to the dipole processing of the second audio channel signal $s_R(t)$. An exemplary frequency response of the filter bank elements 130-L and 130-R is shown on the right hand side of FIG. 14A.

The apparatus 1400 differs from the apparatus 1300 in that it comprises four transducers 120-1, 120-2, 120-3, 120-4 instead of only two transducers 120-L and 120-R. Furthermore, each filter bank element 130-L, 130-R of a dipole steering unit 1402 of the apparatus is configured to separate its received audio channel signal $s_L(t)$, $s_R(t)$ into 4 subbands: low frequencies (referenced as "low" in FIG. 14B and as "Low" in the frequency response of FIG. 14A), comprising audio frequencies approximately below 100 Hz, lower mid frequencies (referenced as "lower mid" in FIG. 14B and as "Dipole 1" in the frequency response of FIG. 14A), comprising audio frequencies approximately ranging from 100 Hz to 1000 Hz, which are processed by dipole steering units 110-1, 110-2, higher mid frequencies (referenced as "higher mid" in FIG. 14B and as "Dipole 2" in the frequency response of FIG. 14A), comprising frequencies approximately ranging from 1000 Hz to 5000 Hz, which are processed by the further dipole steering units 110-3, 110-4, and high frequencies (referenced as "high" in FIG. 14B and as "High" in the frequency response of FIG. 14A), comprising audio frequencies approximately above 5000 Hz. According to the embodiment depicted in FIG. 14B, only the low mid and high mid frequencies of the first and second audio channel signal are processed by the respective dipole steering modules 110-1 to 110-4. The low frequencies and the high frequencies are directly played over the respective transducers.

Figure 14B:
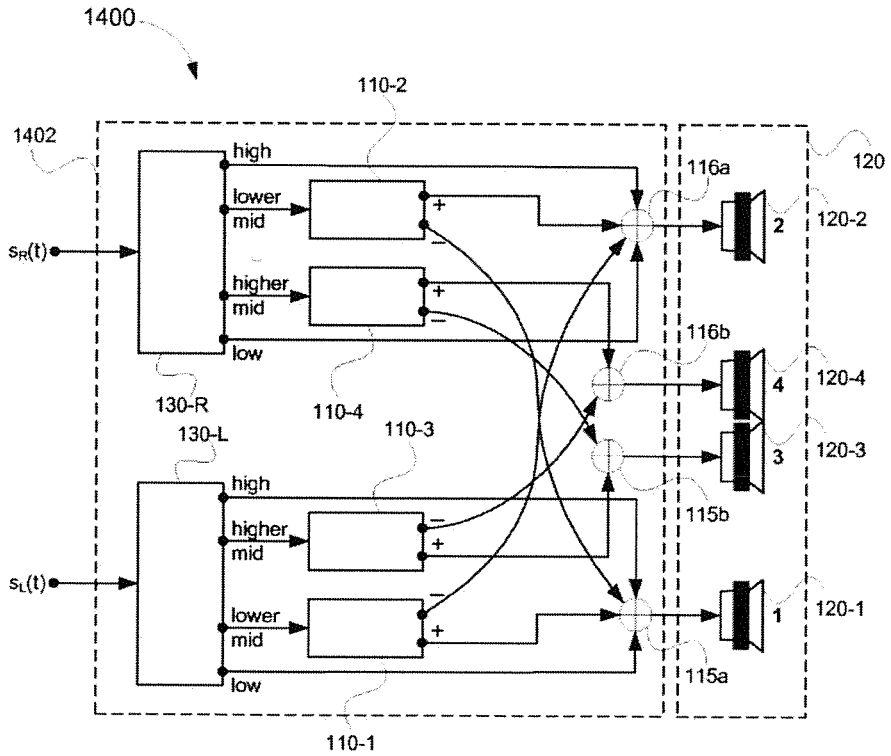
FIG. 14B shows a possible implementation form of the apparatus shown in FIG. 14A according to an embodiment of the invention.

From FIG. 14B a cross connection scheme similar to that in FIG. 13B can be seen.

In the dipole steering unit 1402, a first summation amplifier 115*a* receives the high and low frequencies of the first audio channel signal $s_L(t)$, the filtered version of the lower mid frequencies of the first audio channel signal $s_L(t)$ from a first dipole steering unit 110-1, and the filtered, delayed and inversed version of the lower mid frequencies of the second audio channel signal $s_R(t)$ from a second dipole steering unit 110-2. An output of the first summation amplifier 115*a* is connected to the first transducer 120-1.

Furthermore, a second summation amplifier 116*a* receives the high and low frequencies of the second audio channel signal $s_R(t)$, the filtered version of the lower mid frequencies of the second audio channel signal $s_R(t)$ from the second dipole steering unit 110-2, and the filtered, delayed and inversed version of the lower mid frequencies of the first audio channel signal $s_L(t)$ from the first dipole steering unit 110-1. An output of the second summation amplifier 116*a* is connected to the second transducer 120-2.

Furthermore a third summation amplifier 115*b* receives the filtered version of the higher mid frequencies of the first audio channel signal $s_L(t)$ from a third dipole steering unit 110-3, and the filtered, delayed and inversed version of the higher mid frequencies of the second audio channel signal $s_R(t)$ from a fourth dipole steering unit 110-4. An output of the third summation amplifier 110-3 is connected to the third transducer 120-3.

Finally a fourth summation amplifier 116*b* receives the filtered version of the higher mid frequencies of the second audio channel signal $s_R(t)$ from the fourth dipole steering unit 110-4, and the filtered, delayed and inversed version of the higher mid frequencies of the first audio channel signal $s_L(t)$ from the third dipole steering unit 110-3. An output of the fourth summation amplifier 110-4 is connected to the fourth transducer 120-4.

Based on the circuit shown in FIG. 14B with the four transducers 120-1, 120-2, 120-3, 120-4 two dipoles with an increased frequency range of the spatial effect can be achieved.

According to the embodiment shown in FIGS. 14A and 14B, a first band limited dipole signal (based on the output signals at the summation amplifiers 115*a*, 116*a*) is emitted by a first pair, denoted 1 and 2, of transducers 120-1, 120-2 of the transducer unit 120, forming a first dipole 1 (low frequency dipole) with a transducer spacing of, for example, 0.2 m. The second band limited dipole signal (based on the output signals at the summation amplifiers 115*b*, 116*b*) is emitted by a second pair, denoted 3 and 4, of transducers 120-3, 120-4 of the transducer unit 120, forming a second dipole 2 (high frequency dipole) with a transducer spacing smaller than the spacing of the first pair of transducers, for example, of 0.1 m, wherein the first pair of transducers and the second pair of transducers are located in fixed position with respect to each other.

To summarize, FIGS. 14A, 14B show an apparatus 1400 for enhancing a spatial perception of an audio signal with four transducers according to an embodiment of the invention.

By using the two pairs of transducers 120-1, 120-2, 120-3, 120-4, with differing distance d and two different subbands for the dipole steering, the effective frequency range of the enhanced spatial effect can be increased. The different distance d requires a different delay $\tau$ according to Eqn. 6. Also the equalization filter 150 is adapted according to the differing distance d.

As described, low and high frequencies are directly provided to the transducers 120-1, 120-2 (denoted 1 and 2). The lower mid frequencies are provided to the low frequency dipole 1 (d=0.2 m), the higher mid frequencies are provided to the high frequency dipole 2 (d=0.1 m). For such embodiments, the transition frequency between the two dipoles (Dipoles 1 and 2 in FIG. 14A) can be configured to be around 3000 Hz, the upper transition frequency of the high frequency dipole (Dipole 2 in FIG. 14A) can be set to around 7000 Hz. Other embodiments may comprise other transducer distances and other transition frequencies, wherein the optimal values for the transition frequencies depend on the distance d and the rotation angle $\alpha$.

Figure 15A:
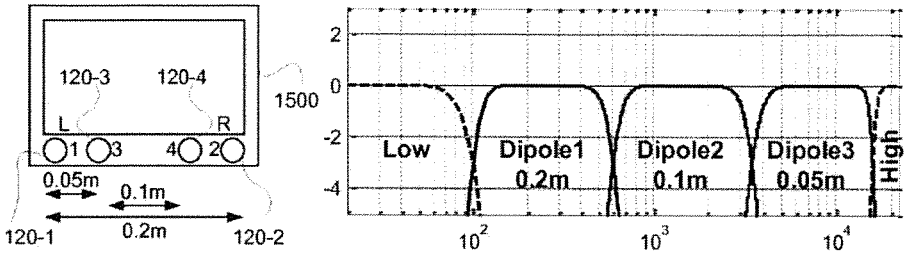
FIG. 15A shows an apparatus for enhancing a spatial perception of an audio signal with four transducers according to an even further embodiment of the invention together with a corresponding frequency response of a filter bank implemented in this apparatus.
Figure 15B:
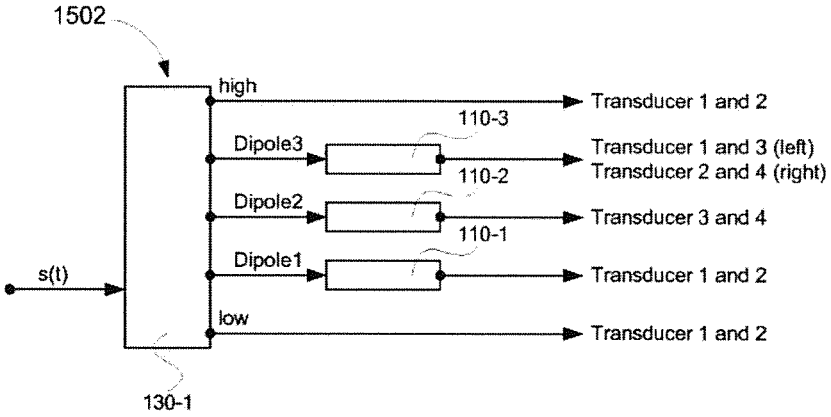
FIG. 15B shows a possible implementation form of the apparatus shown in FIG. 15A according to an embodiment of the invention.

FIG. 15A shows a device 1500 according to an embodiment of the present invention. The device 1500 comprises an apparatus 1502 (partially shown in FIG. 15B) for enhancing a spatial perception of an audio signal according to an embodiment of the invention with four transducers 120-1, 120-2, 120-3, 120-4. Furthermore an exemplary corresponding frequency response of a filter bank element 130-1 used in such apparatus is shown. A possible implementation form of a filter bank element 130-1 with three dipole steering modules 110-1 of such an apparatus is shown in FIG. 15B. Actually, FIG. 15B shows only the elements of one signal path, i.e., the elements of the apparatus 1502 for the left channel signal $s_L(t)$ or right channel signal $s_R(t)$. The complete block diagram of the apparatus 1502 would correspond to the one shown in FIG. 14B but having 5 filter bank element outputs (low, lower mid, middle mid, higher mid and high frequencies depicted as "low"/"Low", "Dipole 1", Dipole 2, Dipole 3 and "high"/"High" in FIGS. 15A and 15B) for each channel instead of 4, and three corresponding dipole steering modules 110-1, 110-1 and 120-3 for each channel instead of 2.

Thus, contrary to FIGS. 14A, 14B, three dipoles are provided in the setup as shown in FIGS. 15A and 15B. Therefore, the frequency range of the dipole processing is band-limited through the filter bank element 130-1. The stereo signal s(t) is separated by the filter bank element 130-1 into five subbands: an additional middle mid frequencies band is introduced, resulting in three subbands to be processed by the dipole steering. Dipole 1 is configured to process lower mid frequencies, for example with a transducer spacing of 0.2 m, dipole 2 is configured to process middle mid frequencies, for example with a transducer spacing of 0.1 m, and dipole 3 is configured to process higher mid frequencies, for example with a transducer spacing of 0.05 m. Furthermore, the frequency ranges of the 3 dipoles can be seen in the frequency response diagram in FIG. 15A.

When compared to the apparatus 1400 (transducer arrangement as shown in FIG. 14A), the frequency range of the spatial effect can be further extended to high frequencies by creating the further dipole between the transducers 120-1 and 120-3 as well as between 120-2 and 120-4 (transducer arrangement as shown in FIG. 15A is the same as shown in FIG. 14A), for example with a distance d of 0.05 m. Therefore, only four transducers are required to create three dipoles spanning a further enlarged frequency range. The additional high frequency dipole can be configured to process the frequency range from, for example, 6000 Hz to 13000 Hz.

In the apparatus shown in part in FIGS. 15A and 15B, low and high frequencies are directly played over the respective transducers 120-1, 120-2. Each of the remaining three subbands of the mid frequencies is processed by a dipole steering module, i.e. lower mid frequencies are processed by a dipole steering module 110-1, middle mid frequencies are processed by a dipole steering module 110-2, and higher mid frequencies are processed by a dipole steering module 110-3.

The connection of each of the four transducers 120-1, 120-2, 120-3, 120-4 as illustrated in FIG. 15A to the output of the circuitry of the apparatus shown partly in FIG. 15B is tabled on the right side of FIG. 15B. The dipole 3 comprising, for example, a spacing of 0.05 m is provided two times, therefore, the signal can be split into a left channel signal and a right channel signal.

Figure 16:
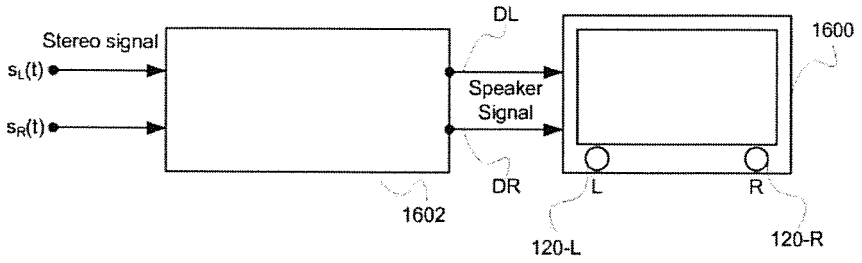
FIGS. 16-18 show further implementation forms of the apparatus for enhancing a spatial perception of an audio signal according to embodiments of the invention.
Figure 17:
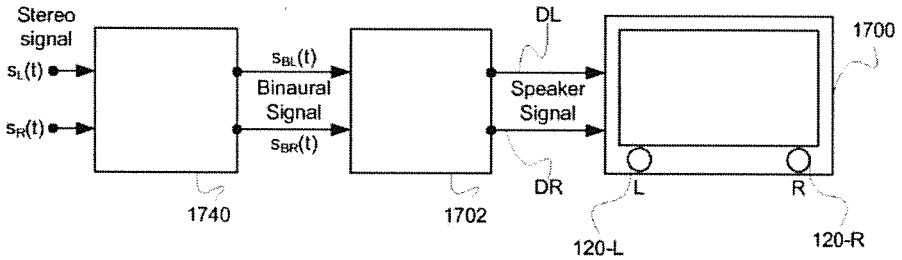
Figure 18:
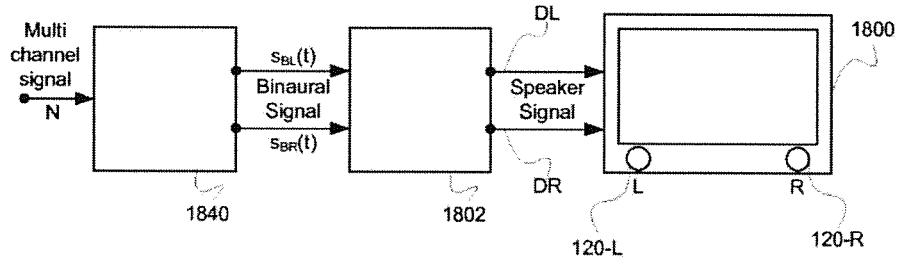

Each of FIGS. 16-18 shows a scenario of using the apparatus for enhancing a spatial perception of an audio signal according to an embodiment of the invention. The apparatus and the method for enhancing a spatial perception of a two-channel audio signal can be used to obtain enhanced spatial effects among others in the following different scenarios.

FIG. 16 shows a scenario of using the apparatus for enhancing a spatial perception of an audio signal according to an embodiment of the invention.

A stereo signal s(t) comprising a left audio channel signal $s_L(t)$ and a right audio channel signal $s_R(t)$ is provided to an input of a dipole steering unit 1602, for example a dipole steering unit 1202 or 1302 for two transducers 120-L and 120-R as described based on FIGS. 12 and 13. The dipole steering unit is adapted to output a left transducer driving signal DL to the left side transducer 120-L and a right transducer driving signal DR to the right side transducer 120-R of the device 1600. The device 1600 can be any device, in particular a small device like a smartphone, tablet, docking station or sound-bar with integrated transducers.

Processing stereo signals according to embodiments of the invention results in a stereo widening effect which is based on the increased interaural-level differences. Stereo widening refers to the perception of sound sources which are located outside of the loudspeaker span angle θ (see FIG. 1) and may span up to 180°.

FIG. 17 shows a scenario of using the apparatus for enhancing a spatial perception of an audio signal according to an embodiment of the invention.

As shown in FIG. 17, stereo widening with additional HRTF processing is used. Creating a crosstalk cancellation effect, it is possible to add Head-Related-Transfer-Functions (HRTF) filtering in order to obtain a binaural signal. Applying this processing to a stereo signal, the stereo widening effect is increased because it is not only based on interaural-level differences but includes the entire set of localization cues captured by the HRTFs, such as interaural-time differences.

A stereo signal s(t) comprising a left audio channel signal $s_L(t)$ and a right audio channel signal $s_R(t)$ is provided to an input of a HRTF processing unit 1740. An output of the HRTF processing unit 140 provides a binaural signal comprising a left binaural signal $s_{BL}(t)$ and a right binaural signal $s_{BR}(t)$ to the dipole steering unit 1702 as first and second audio channel signal. The dipole steering unit 1702 is, for example, a dipole steering unit 1202 or 1302 for two transducers 120-L and 120-R as described based on FIGS. 12 and 13. The dipole steering unit is adapted to output a left transducer driving signal DL to the left side transducer 120-L and a right transducer driving signal DR to the right side transducer 120-R of the device 1700. The device 1700 can be any device, in particular a small device like a smartphone, tablet, docking station or sound-bar with integrated transducers.

FIG. 18 shows a scenario of using the apparatus for enhancing a spatial perception of an audio signal according to an embodiment of the invention.

As shown in FIG. 18, a virtual surround or 3D audio sound is generated. Creating a crosstalk cancellation effect and adding HRTF filtering, it is possible to create a virtual surround or 3D audio playback where sources are positioned virtually all around the listener. Virtual surround or 3D refers to a perception of audio sources positioned in the entire 360° plane around the listener's head.

A multichannel signal is provided to an input of a HRTF processing unit 1840. The multi-channel comprises a plurality N of audio channel signals, typically more than 2, but may also be represented by a downmix signal and corresponding spatial side information. An output of the HRTF processing unit 1840 provides a binaural signal comprising a left binaural signal $s_{BL}(t)$ and a right binaural signal $s_{BR}(t)$ to the dipole steering unit 1802 as first and second audio channel signal. The dipole steering unit 1802 is, for example, a dipole steering unit 1202 or 1302 for two transducers 120-L and 120-R as described based on FIGS. 12 and 13. The dipole steering unit is adapted to output a left transducer driving signal DL to the left side transducer 120-L and a right transducer driving signal DR to the right side transducer 120-R of the device 1800. The device 1800 can be any device, in particular a small device like a smartphone, tablet, docking station or sound-bar with integrated transducers.

Figure 19:
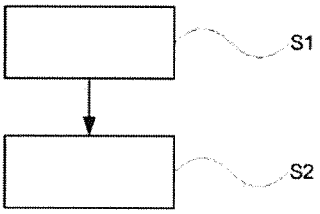
FIG. 19 shows a method for enhancing a spatial perception of an audio signal according to an embodiment of the invention.

FIG. 19 shows a flow diagram of a method for enhancing a spatial perception of an audio signal according to an embodiment of the invention.

The method for enhancing a spatial perception of a two-channel audio signal may comprise the following steps.

Producing S1 a first dipole signal based on the first audio channel signal and producing a second dipole signal based on the second audio channel signal, wherein the first dipole signal and the second dipole signal are produced such that, when output via the transducer unit, a first zero sound propagation direction of the first dipole signal has a positive azimuth angle with regard to a steering reference direction, and a second zero sound propagation direction of the second dipole signal has a negative azimuth angle with regard to the steering reference direction.

Transducing S2 the first dipole signal and the second dipole signal by means of a transducer unit 120.

It should be noted that embodiments of the invention can be implemented not only in or by those devices or methods as described, for example, based on FIGS. 1 to 3 or FIGS. 16 to 18, but in many other ways, e.g., in or as any devices such as a mobile phone, a smartphone, a personal digital assistant (PDA), an mp3 player, an iPod, a tablet, a notebook, a desktop PC, a game console, a photo camera or video camera or TV sets, or combinations thereof. Embodiments of the invention can be implemented in particular in or as small devices which are used with a close distance to the listener and/or are even held by the listener during sound reproduction. The apparatus or devices comprising the apparatus according to the invention may comprise an integrated transducer unit or may be at least connectable to a separate transducer unit and are adapted to produce and output the first and second dipole signal when connected to the separate transducer unit. Accordingly, embodiments of the apparatus or device may, e.g., be implemented by a smartphone alone, with or without its integrated transducers, or in combination with the transducers of a separate docking station or sound-bar. In even further embodiments, a smartphone, e.g., may only be adapted to provide conventional stereo signals, and the docking station to which the smartphone is connected, forms the apparatus according to the invention comprising the dipole steering unit and the transducer unit as integrated transducer unit.

In embodiments of the invention the delaying modules 114 of the first and second dipole steering units 110-L and 110-R (e.g., in FIGS. 11, 12 and 13B) may be adapted to apply the same delay to, thus, produce a symmetric steering of the first and second dipole signal DSL and DSR with regard to the steering reference direction SDR, e.g., to obtain a zero sound propagation direction ZDL of the first dipole signal DSL with a positive azimuth $\alpha_L$ having the same magnitude as the negative azimuth $\alpha_R$ of the zero sound propagation direction ZDR of the second dipole signal DSR. A symmetric steering provides an enhanced spatial perception for the typical use scenarios in which the listener faces the device in a centered manner, as shown, e.g. FIGS. 1, 5A and 7 to 9.

However, it should be noted that also non-symmetric steering, e.g., by applying different steering angles based on different delays in the delaying modules 114 of the first and second dipole steering units 110-L and 110-R, may provide an enhanced spatial perception (increased ILD or crosstalk cancellation) compared to conventional solutions, although typically the perception improves with increasing symmetry, i.e., the smaller the difference of the magnitudes of the steering angles is.

It should be further noted that alternative embodiments of the apparatus 1100 may comprise alternative implementations to steer the dipole signals and in particular the zero propagation directions of the dipole signals to achieve the same effect. Embodiments may, e.g., not comprise a filtering module 150. Further embodiments may swap the location of the left and right transducer 120-L1 and 120-L2 of the left transducer pair and/or the location of the left and right transducer 120-R1 and 120-R2 of the right transducer pair, or may swap the electrical connections between the positive and negative phase outputs and the corresponding transducers, e.g. connect the left transducer 120-L1 of the left transducer pair with the negative phase output of the left dipole steering module 110-L and to connect the right transducer 120-L2 of the left transducer pair with the positive phase output of the left dipole steering module 110-L.

For ease of understanding, with regard to the description of the various embodiments of the invention angles have been defined to be positive angles in counter-clockwise direction. However, it is to be understood that for embodiments of the invention angles may also be defined to be positive angles in clockwise direction. In the latter case the inverse applies correspondingly.

Furthermore, it should be noted that for ease of understanding, embodiments of the invention have been primarily been described based on stereo signals s (t) as two-channel signal, the stereo signal s(t) comprising a left channel audio signal $s_L(t)$ and a right channel audio signal $s_R$ (t), wherein the left channel audio signal $s_L(t)$ formed the first input signal ASL and the right channel audio signal $s_R(t)$ formed the second input signal ASR. However, embodiments of the invention are also adapted to use other audio signals as two-channel signal, e.g., binaural signals or any other two audio channels, e.g., each captured by a dedicated microphone or one or both audio channel signals synthetically generated, to providing an enhanced spatial perception of the two audio channel signals.

From the foregoing, it will be apparent to those skilled in the art that a variety of methods, systems, computer programs on recording media, and the like, are provided.

The present disclosure also supports a computer program product including computer executable code or computer executable instructions that, when executed, causes at least one computer to execute the performing and computing steps described herein.

Many alternatives, modifications, and variations will be apparent to those skilled in the art in light of the above teachings. Of course, those skilled in the art readily recognize that there are numerous applications of the invention beyond those described herein.

While the present invention has been described with reference to one or more particular embodiments, those skilled in the art recognize that many changes may be made thereto without departing from the scope of the present invention. It is therefore to be understood that within the scope of the appended claims and their equivalents, the inventions may be practiced otherwise than as specifically described herein.

In the claims, the word "comprising" does not exclude other elements or steps, and the indefinite article "a" or "an" does not exclude a plurality. A single processor or other unit may fulfill the functions of several items recited in the claims.

The mere fact that certain measures are recited in mutually different dependent claims does not indicate that a combination of these measured cannot be used to advantage. A computer program may be stored or distributed on a suitable medium, such as an optical storage medium or a solid-state medium supplied together with or as part of other hardware, but may also be distributed in other forms, such as via the Internet or other wired or wireless telecommunication systems.

What is claimed is:

1. An apparatus for enhancing a spatial perception of a two-channel audio signal comprising a first audio channel signal and a second audio channel signal, the apparatus comprising:

a dipole steering unit, comprising:

a filter bank configured to separate each of the first audio channel signal and the second audio channel signal into at least a low frequency subband component, a mid frequency subband component and a high frequency subband component;

a first dipole steering module configured to receive and process the mid frequency component of the first audio channel signal and to produce a first dipole signal based on the first audio channel signal;

a second dipole steering module configured to receive and process the mid frequency component of the second audio channel signal and to produce a second dipole signal based on the second audio channel signal;

a first summation amplifier configured to receive and sum the mid frequency component of the first audio channel signal from the first dipole steering module and the low frequency component and the high frequency component of the first audio channel signal from the filter bank, and to output the summed signal as a first transducer driving signal; and a second summation amplifier configured to receive and sum the mid frequency component of the second audio channel signal from the second dipole steering module and the low frequency component and the high frequency component of the first audio channel signal from the filter bank, and to output the summed signal as a second transducer driving signal;

wherein the first dipole steering module and the second dipole steering module are configured to produce the first dipole signal and the second dipole signal such that, when output via a transducer unit which comprises at least one pair of transducers, a first zero sound propagation direction of the first dipole signal has a positive azimuth angle with regard to a steering reference direction, and a second zero sound propagation direction of the second dipole signal has a negative azimuth angle with regard to the steering reference direction.

2. The apparatus according to claim 1, wherein the first dipole steering module and the second dipole steering module are configured to further produce the first dipole signal and the second dipole signal such that, when output via the transducer unit, a first main sound propagation direction of the first dipole signal has a negative azimuth angle with regard to the steering reference direction, and a second main sound propagation direction of the second dipole signal has a positive azimuth angle with regard to the steering reference direction.

3. The apparatus according to claim 1, wherein:

the first audio channel signal is a left audio channel signal and the second audio channel signal is a right audio channel signal; and the first dipole steering module and the second dipole steering module are configured to further produce the first dipole signal and the second dipole signal such that, when the steering reference direction points towards a user facing the transducer unit, the first zero propagation direction points towards the right ear of the user, and the second propagation direction points towards the left ear of the user.

4. The apparatus according to claim 1, wherein the transducer unit comprises:

a first pair of transducers configured to emit the first dipole signal; and a second pair of transducers configured to emit the second dipole signal, wherein the first pair of transducers and the second pair of transducers are located in a fixed position with respect to each other.

5. The apparatus according to claim 4, wherein the first pair of transducers and the second pair of transducers are spaced by a distance of less than 40 cm.

6. The apparatus according to claim 1, wherein the first dipole steering module and the second dipole steering module are configured to produce the first dipole signal and the second dipole signal such that, when output via the transducer unit, perceivable interaural-level differences in a sound field are generated by the transducer unit.

7. The apparatus according to claim 1, wherein the transducer unit comprises only one pair of transducers, and wherein the transducer unit is connected to the dipole steering module such that the transducer unit is configured to emit the first dipole signal and the second dipole signal.

8. The apparatus according to claim 1, wherein each of the first dipole signal and the second dipole signal comprises a first signal component and a second signal component which are different with respect to sign and phase.

9. The apparatus according to claim 8, wherein the dipole steering unit is configured to adapt the first audio channel signal and the second audio channel signal such that a difference in phase between the first signal component and the second signal component is obtained by delaying the first signal component or the second signal component.

10. The apparatus according to claim 8, wherein the dipole steering unit is configured to adapt the first audio channel signal and the second audio channel signal such that a difference in sign between the first signal component and the second signal component is obtained by inverting the first signal component or the second signal component.

11. A device comprising:

at least one pair of speakers; and an apparatus configured to enhance a spatial perception of a two-channel audio signal comprising a first audio channel signal and a second audio channel signal, the apparatus comprising:

a dipole steering unit, comprising:

a filter bank configured to separate each of the first audio channel signal and the second audio channel signal into at least a low frequency subband component, a mid frequency subband component and a high frequency subband component;

a first dipole steering module configured to receive and process the mid frequency component of the first audio channel signal and to produce a first dipole signal based on the first audio channel signal;

a second dipole steering module configured to receive and process the mid frequency component of the second audio channel signal and to produce a second dipole signal based on the second audio channel signal;

a first summation amplifier configured to receive and sum the mid frequency component of the first audio channel signal from the first dipole steering module and the low frequency component and the high frequency component of the first audio channel signal from the filter bank, and to output the summed signal as a first transducer driving signal; and a second summation amplifier configured to receive and sum the mid frequency component of the second audio channel signal from the second dipole steering module and the low frequency component and the high frequency component of the first audio channel signal from the filter bank, and to output the summed signal as a second transducer driving signal;

wherein the first dipole steering module and the second dipole steering module are configured to produce the first dipole signal and the second dipole signal such that, when output via a transducer unit which comprises at least one pair of transducers, a first zero sound propagation direction of the first dipole signal has a positive azimuth angle with regard to a steering reference direction, and a second zero sound propagation direction of the second dipole signal has a negative azimuth angle with regard to the steering reference direction; and wherein the at least one pair of transducers is associated with the at least one pair of speakers.

12. The device according to claim 11 wherein the device comprises a mobile device, a docking station or a soundbar.

13. A method for enhancing a spatial perception of a two-channel audio signal comprising a first audio channel signal and a second audio channel signal, the method comprising:

separating, at a filter bank, each of the first audio channel signal and the second audio channel signal into at least a low frequency subband component, a mid frequency subband component and a high frequency subband component;

processing, at a first dipole steering module, the mid frequency component of the first audio channel signal and producing a first dipole signal based on the first audio channel signal;

processing, at a second dipole steering module, the mid frequency component of the second audio channel signal and producing a second dipole signal based on the second audio channel signal;

summing, at a first summation amplifier, the mid frequency component of the first audio channel signal from the first dipole steering module and the low frequency component and the high frequency component of the first audio channel signal from the filter bank, and outputting the summed signal as a first transducer driving signal; and summing, at a second summation amplifier, the mid frequency component of the second audio channel signal from the second dipole steering module and the low frequency component and the high frequency component of the first audio channel signal from the filter bank, and outputting the summed signal as a second transducer driving signal;

producing a first dipole signal based on the first audio channel signal and producing a second dipole signal based on the second audio channel signal, wherein the first dipole signal and the second dipole signal are produced such that, when output via a transducer unit comprising at least a pair of transducers, a first zero sound propagation direction of the first dipole signal has a positive azimuth angle with regard to a steering reference direction, and a second zero sound propagation direction of the second dipole signal has a negative azimuth angle with regard to the steering reference direction.

14. The method according to claim 13, further comprising:

adapting a left side signal and a right side signal to generate perceivable interaural-level differences in a sound field generated by the transducer unit.

15. The apparatus according to claim 5, wherein the first pair of transducers and the second pair of transducers are spaced by a distance of less than 10 cm.

16. The apparatus according to claim 15, wherein the first pair of transducers and the second pair of transducers are spaced by a distance of less than 5 cm.

* * * * *